United States Patent [19]

Kando

[11] Patent Number: 4,772,915

[45] Date of Patent: Sep. 20, 1988

[54] ELECTROPHOTOGRAPHIC PRINTER HAVING COMPACT IMAGE DEVELOPMENT ARRANGEMENT

[75] Inventor: Giichi Kando, Morioka, Japan

[73] Assignee: Alps Electric Co., Ltd., Japan

[21] Appl. No.: 7,616

[22] Filed: Jan. 28, 1987

[30] Foreign Application Priority Data

Apr. 18, 1986 [JP] Japan ..... 61-58356[U]
Apr. 18, 1986 [JP] Japan ..... 61-28357[U]

[51] Int. Cl.[4] ..... G03G 15/00
[52] U.S. Cl. ..... 355/3 R; 346/153.1; 355/3 DD
[58] Field of Search ..... 355/3 R, 3 DD, 15, 3 FU, 355/3 SH; 219/216; 346/153.1, 160

[56] References Cited

U.S. PATENT DOCUMENTS 3,411,932 11/1968 Malone et al. ..... 355/3 FU
3,532,855 10/1970 Van Cleave ..... 219/216
3,957,509 5/1976 McMullen et al. ..... 355/15
4,232,959 11/1980 Ateya et al. ..... 355/3 FU
4,360,944 11/1982 Iwai et al. ..... 355/15 X
4,395,114 7/1983 Ura et al. ..... 355/15
4,427,285 1/1984 Stange ..... 355/3 FU
4,660,960 4/1987 Fukunaga et al. ..... 355/15 X

FOREIGN PATENT DOCUMENTS 1476962 6/1977 United Kingdom .

*Primary Examiner*—R. L. Moses
*Attorney, Agent, or Firm*—Guy W. Shoup; Paul J. Winters

[57] ABSTRACT

An electrophotographic printer includes a photosensitive member, a charger for accumulating electrostatic charges on the surface of the photosensitive member, an optical writing member for forming an electrostatic latent image on the surface of the photosensitive member, a developing device for making the latent image on the photosensitive member visible by means of a developer, a transfer device for transferring the visible image to a recorded material, a charge remover for removing any charge remaining on the photosensitive member, and a cleaner for removing any developer remaining on the photosensitive member. A developer moving passage is defined between the developing device and the cleaner for moving the developer from the cleaner to the developing device. The charger and the optical writing member are disposed between the developing device and the cleaner. A fixing device for fixing a visible image which has been transferred from the photosensitive member to the recording material is disposed in the vicinity of an upper wall of a housing, and an opening is provided in the upper wall of the housing for discharging the recording material passed through the fixing device onto the upper wall.

2 Claims, 1 Drawing Sheet

ELECTROPHOTOGRAPHIC PRINTER HAVING COMPACT IMAGE DEVELOPMENT ARRANGEMENT

BACKGROUND OF THE INVENTION

1. Field of the Invention

The present invention relates to printers such as those associated with computers and facsimile systems, laser printers, LED printers and liquid-crystal printers. More particularly, the present invention pertains to electrophotographic printers of the type in which a visible image produced by a developer in accordance with image data is formed on a recording material by an electrophotographic method.

2. Description of the Related Art

The above-described electrophotographic method has originally been adopted in copying machines. However, electrophotographic systems have recently been widely employed as image output devices, i.e., printers, because they feature high printing quality, high-speed printing and low noise level.

In electrophotographic printers which employ a toner, i.e., colored fine particles, as a developer, after a visible image of toner formed on a photosensitive member has been transferred to a recording material, the toner remaining on the photosensitive member must be removed by a cleaner. In such case, the toner removed from the photosensitive member by the cleaner has heretofore been discarded without being reused, uneconomically.

In order to overcome such disadvantage, one type of electrophotographic printer has already been developed which enables the toner removed from the photosensitive member by the cleaner to be reused.

Such conventional electrophotographic printer, which enables the toner to be reused, will first be described with reference to FIG. 2.

An electrophotographic printer of the type described above has a housing 1 in which a photosensitive drum 2 as one example of the photosensitive member is disposed in such a manner that the drum 2 is rotatable in the direction of the arrow. A charger 3 is disposed within the housing 1 and to one side of the photosensitive drum 2, the charger 3 being adapted to accumulate electrostatic charges on the surface of the drum 2. This charger 3 also serves as a transfer device which transfers a visible image of toner to a sheet of recording paper as one example of the recording material. An optical writing member 4 is disposed within the housing 1 and above the photosensitive drum 2, the member 4 having a laser head 5 for forming an electrostatic latent image on the drum 2 charged by the chager 3. A developing device 6 which also serves as cleaner is disposed within the housing 1 and to the other side of the photosensitive drum 2. The developing device 6 has a casing 7, and a blade 8 is disposed in the upper part of the casing 7, the blade 8 being brought into contact with the photosensitive drum 2 so as to function as a cleaner. A developing sleeve 9 is disposed in the lower part of the casing 7, the sleeve 9 being adapted to attach a toner T filled within the casing 7 to the photosensitive drum 2. In addition, a charge remover 10 for removing any charge remaining on the photosensitive drum 2 is disposed within the housing 1 and below the drum 2.

A hopping roller 12 is disposed in the lower part of the housing 1 for supplying sheets of recording paper in a paper feed cassette 11 one by one. A transport passage 13 having transport rollers 14 is defined inside the housing 1 so that each sheet of recording paper supplied from the paper feed cassette 1 is passed through the area defined between the photosensitive drum 2 and the charger 3. In addition, a fixing device 15 having a pair of fixing rollers 16 and a pair of transport rollers 17 is disposed at the downstream side of the transfer passage 13 so that a visible image of toner adhering to the surface of the recording paper is fixed thereto by heat and pressure. The recording paper which has passed the fixing device 15 is discharged onto a deliver tray 18 which is provided in the housing 1 in such a manner as to project therefrom, the recording paper being delivered in a face-up state, i.e., in a state wherein the printed surface of the paper is directed upward.

With the above-described arrangement, the photosensitive drum 2 is charged at a predetermined potential by means of corona discharge caused by the charger 3 during a first turn of the drum 2, and an electrostatic latent image is formed on the surface of the drum 2 by the optical writing member 4 through exposure in accordance with particular image data. Thereafter, a toner T uniformly charged by friction or injection of electric charges is transported within the casing 7 to a position which faces the photosensitive drum 2 by means of the developing sleeve 9, and the toner T is selectively attracted to the surface of the drum 2 so as to adhere thereto in correspondence with the latent image, thereby forming a visible image. Then, the uppermost one of the sheets of recording paper in the paper feed cassette 11 is transported to the area between the photosensitive drum 2 and the developing device 6 serving also as a transfer device by the action of hopping roller 12 and the transport rollers 14, and corona discharge is caused by the developing device 6 from the rear side of the recording paper during a second turn of the photosensitive drum 2, thereby transferring the visible image of toner T on the drum 2 to the recording paper. The transferred visible image is fixed to the recording paper by the operation of the fixing device 15 to obtain a final image.

The residual surface potential on the unexposed area of the photosensitive drum 2 is optically made zero by the charge remover 10. On the other hand, the toner T which has not been transferred and remains on the photosensitive drum 2 is removed from the drum 2 by the blade 8 and dropped into the casing 7 so as to be reused, thus completing one printing process.

The above-described conventional electrophotographic printer, shown in FIG. 2, suffers, however, from the following problems. Due to the positional relationship between the photosensitive drum 2 and the optical writing member 4, the drum 2 needs to be rotated two turns in order to complete one printing process, which means that the printing efficiency is unfavorably low.

Further, since the electrophotographic printer shown in FIG. 2 discharges recording paper in a face-up state, when information which needs a plurality of sheets of recording paper is printed in a paginal sequence, one sheet of recording paper which should be placed under another is laid on top of the latter, which means that the stacked sheets of recording paper must be rearranged after printing.

In addition, since the fixing device 15 is disposed at the substantially central position inside the housing 1, special consideration is needed to eliminate adverse effects of the heat generated in the fixing device 15 on various devices and members such as the photosensitive drum 2.

SUMMARY OF THE INVENTION

In view of the above circumstances, it is an object of the present invention to provide an electrophotographic printer which enables one printing process to be completed by one turn of a photosensitive member such as a photosensitive drum and which permits the residual developer on the photosensitive member to be reused.

It is another object of the present invention to provide an electrophotographic printer which enables a sheet of recording paper to be discharged in a face-down state while lowering the frequency of generation of jamming of recording paper and in which the heat generated in the fixing device has no adverse effect on other devices and members.

To this end, the present invention provides an electrophotographic printer comprising: a photosensitive member; a charger for accumulating electrostatic charges on the surface of the photosensitive member; an optical writing member for forming an electrostatic latent image on the surface of the photosensitive member; a developing device for making the latent image on the photosensitive member visible by means of a developer; a transfer device for transferring the visible image to a recording material; a charge remover for removing any charge remaining on the photosensitive member; a cleaner for removing any developer remaining on the photosensitive member; and a developer moving passage provided between the developing device and the cleaner for moving the developer from the cleaner to the developing device, the charger and the optical writing member being disposed between the developing device and the cleaner.

According to another aspect of the present invention, there is provided an electrophotographic printer comprising: a fixing device for fixing a visible image which has been transferred from a photosensitive member to a recording material, the fixing device being disposed in the vicinity of an upper wall of a housing; and an opening provided in the upper wall of the housing for discharging the recording material passed through the fixing device onto the upper wall.

According to the present invention, the charger and the optical writing member are disposed between the developing device and the cleaner. Therefore, immediately after the developer remaining on the photosensitive member has been removed by the cleaner, the photosensitive member can be charged by the charger to allow an electrostatic latent image to be formed on the photosensitive member by means of the optical writing member, so that it is possible to complete one printing process by rotating the photosensitive member only one turn. Since the developer moving passage is formed between the developing device and the cleaner, it is possible to reuse the developer removed from the photosensitive member by the action of the cleaner. Further, since the recording material is discharged directly from the opening provided in the upper wall of the housing, it is possible to discharge the recording material onto the upper wall of the housing. In addition, the passage for transporting the recording material is shortened to allow lowering in the frequency of generation of jamming of the recording material. Furthermore, since the fixing device is disposed in the vicinity of the upper wall of the housing, the heat generated in the fixing device can be released through the upper wall of the housing.

The above and other objects, novel features and advantages of the present invention will become more apparent from the following description of the preferred embodiment thereof, taken in conjunction with the accompanying drawings.

DESCRIPTION OF THE PREFERRED EMBODIMENT

One preferred embodiment of the present invention will be described hereinunder in detail with reference to FIG. 1.

Figure 1:
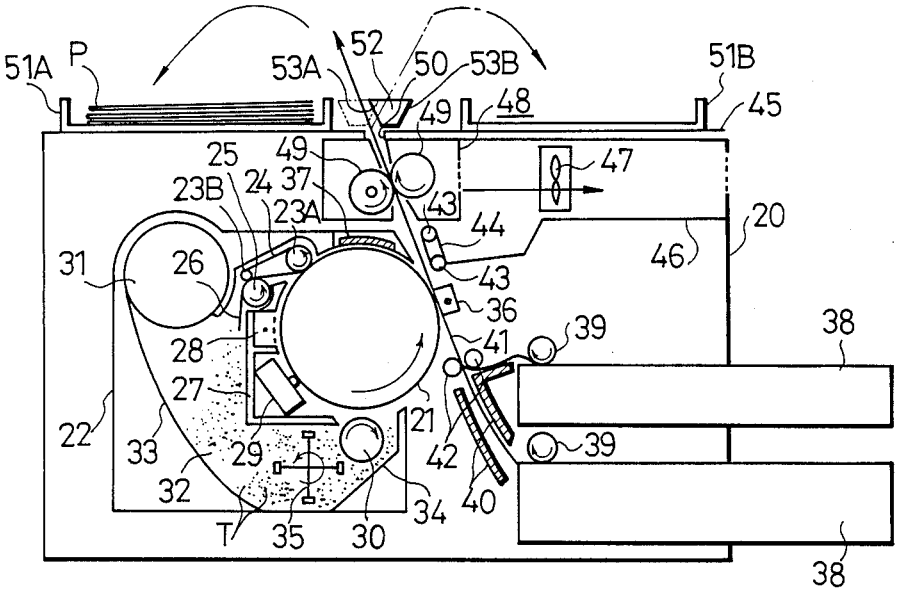
FIG. 1 is a vertically-sectioned front view of one embodiment of the electrophotographic printer according to the present invention.
Figure 2:
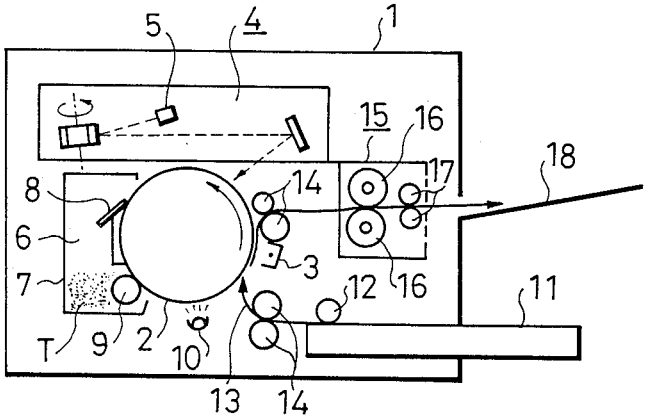
Fig.2 PRIOR ART
FIG. 2 is a vertically-sectioned front view schematically showing a conventional electrophotographic printer.

Referring to FIG. 1, which is a vertical sectional view of one embodiment of the present invention, the electrophotographic printer according to the present invention has a housing 20, in which a photosensitive drum 21 as one example of a photosensitive member is disposed in such a manner as to be rotatable in the direction of the arrow. A casing 22 is disposed within the housing 20 and to the left of the photosensitive drum 21, the casing 22 extending from the upper side to the lower side of the drum 21 so as to cover it. A cleaning belt 24 is disposed in the upper part of the casing 22 in such a manner as to be in contact with the photosensitive drum 21, the belt 24 being stretched between pulleys 23A and 23B and caused to travel by the rotation of the pulley 23A in the arrowed direction. The pulley 23B having a relatively small diameter is disposed at a position spaced apart from the photosensitive drum 21. A magnet roll 25 is disposed below the pulley 23B, the roll 25 being adapted to rotate in the direction of the arrow so that the toner T attached to the cleaning belt 24 is attracted to the magnet roll 25 so as to adhere thereto. A blade 26 is disposed in the vicinity of the magnet roll 25 in such a manner that the blade 26 is in pressure contact with the roll 25. The toner T magnetically attached to the magnet roll 25 is scraped off by the blade 26.

A frame 27 is disposed at the vertically central position within the casing 22 in such a manner that the frame 27 is in close proximity with the photosensitive drum 21. To this frame 27 are mounted a charger 28 for accumulating electrostatic charges on the surface of the photosensitive drum 21 having the toner T removed by the cleaning belt 24, and an optical writing member 29 such as an LED head for forming an electrostatic latent image on the drum 21 charged at a predetermined potential by the charger 28. A developing sleeve 30 for attaching the toner T to the photosensitive drum 21 is disposed inside the housing 20 and directly below the photosensitive drum 21.

A toner cartridge 31 is detachably loaded in the upper part of the casing 22. A toner moving passage 32 for moving both the toner T in the toner cartridge 31 and the toner T scraped off the magnet roll 25 toward the developing sleeve 30 is defined by the rear surface of the frame 27 and a guide plate 33 disposed inside the casing 22. The guide plate 33 is slanted in such a manner as to extend downward from a position near the toner cartridge 31 while curving slightly. Another guide plate 34 for preventing any toner T from remaining uselessly is obliquely disposed within the casing 22 and directly below the developing sleeve 30. In addition, a stirrer 35 for mixing together under stirring the toner T which has not yet been used and the toner T which is to be reused is disposed in the lower part of the casing 22 in such a manner as to be adjacent to the developing sleeve 30.

A transfer device 36 is disposed within the housing 20 and to the right of the photosensitive drum 21, the transfer device 36 transferring the visible image of toner T on the photosensitive drum 21 to a sheet of recording paper as one example of a recording material. A charge remover 37 is disposed within the housing 20 and above the photosensitive drum 21, the charge remover 37 being defined by a lamp which removes any charge remaining on the photosensitive drum 21.

Two paper feed cassettes 38 can be loaded in the lower part of the housing 20 in such a manner that the cassettes 38 are spaced apart from each other in the vertical direction. Hopping rollers 39 are disposed within the housing 20 for delivering sheets of recording paper within the paper feed cassettes 38 one by one. Paper guides 40 are disposed within the housing 20 for orienting recording paper supplied from the cassettes 38 in a direction in which the recording paper is brought into contact with the surface of the photosensitive drum 21. A transport passage 41 is formed such as to extend from the terminating ends of the paper guides 40, the passage 41 having transport rollers 42 for transporting recording paper so as to pass through the area between the photosensitive drum 21 and the transfer device 36. The transport passage 41 is adapted to transport recording paper obliquely upward. A transport belt 44 which is stretched between a pair of pulleys 43 is disposed at a position on the transport passage 41 at the downstream side of the transfer device 36. The transport belt 44 is provided with a multiplicity of small bores (not shown). An air duct 46 is formed within the housing 20 and to the side of the transport belt 44 in such a manner that the duct 46 extends along an upper wall 45 of the housing 20. A suction fan 47 is disposed within the air duct 46. Accordingly, a stream of air is induced in the arrowed direction by driving the suction fan 47, so that recording paper is transported while being suction-held on the transport belt 44.

A fixing device 48 is disposed directly below the upper wall 45 of the housing 20, the fixing device 48 facing a part of the transport passage 41 on the downstream side of the transfer belt 44. The fixing device 48 has a pair of fixing rollers 49 for fixing the visible image of toner on the recording paper. The heat generated in the fixing device 48 is released to the outside through the air duct 46. The upper wall 45 of the housing 20 is provided with an opening 50 for discharging the recording paper passed through the fixing device 48 onto the upper wall 45 of the housing 20. Further, delivery trays 51A and 51B are disposed on the upper wall 45 of the housing 20 and at both sides, respectively, of the opening 50. The delivery tray 51A is used to receive recording paper in such a manner that the surface of the paper which has a visible image formed thereon is directed downward, while the delivery tray 51B is used to receive recording paper in such a manner that the surface of the paper which has a visible image formed thereon is directed upward. In addition, a guide member 52 in the shape of an isosceles trapezoid is disposed on the upper wall 45 of the housing 20 in such a manner that the guide member 52 is movable to both sides of the opening 50 by a driving source (not shown), the guide member 52 having a slanted guide surface 53A for guiding recording paper to the delivery tray 51A and a slanted guide surface 53B for guiding recording paper to the delivery tray 51B.

The following is a description of the operation of the above-described embodiment.

The photosensitive drum 21 is first charged at a predetermined potential by corona discharge caused by the charger 28 supported by the frame 27 within the casing 22, and an electrostatic latent image corresponding to image information is immediately formed on the charged photosensitive drum 21 by means of the optical writing member 29 disposed adjacent to the charger 28. Then, the developing sleeve 30 disposed adjacent to the optical writing member 29 causes the toner T to be selectively attracted to the surface of the photosensitive drum 21 so as to adhere thereto in correspondence with the electrostatic latent image thereon, thereby forming a visible image of toner T.

On the other hand, recording paper is supplied from either one of the paper feed cassettes 38 by the action of the associated hopping roller 39 and then transported by the transport rollers 42. When the recording paper reaches the area between the photosensitive drum 21 and the transfer device 36, corona discharge is caused by the transfer device 36 to transfer the visible image of toner T on the photosensitive drum 21 to the recording paper. The recording paper having the visible image transferred thereto is suction-held on the transport belt 44 having a multiplicity of small bores by the operation of the suction fan 47, and while doing so, the paper is transported obliquely upward. Then, the recording paper has the visible image of toner T fixed thereto by the fixing device 48 and is discharged onto the housing 20 through the opening 50 provided in the upper wall 45 of the housing 20. When the guide member 52 is positioned as shown by the solid line, the recording paper P is guided along the guide surface 53A of the guide member 52 and placed in the delivery tray 51A in a face-down state, i.e., in a state wherein the surface of the paper which carries the visible image is directed downward. When the guide member 52 is positioned as shown by the imaginary line, the recording paper is guided along the guide surface 53B of the guide member 52 and placed in the delivery tray 51B in a face-up state, i.e., in a state wherein the surface of the paper which carries the visible image is directed upward. It should be noted that the heat generated in the fixing device 48 is released to the outside through the upper wall 45 of the housing 20 and also through the air duct 46 by the operation of the suction fan 47.

On the other hand, a portion of the photosensitive drum 21 from which the visible image has been transferred to the recording paper by the transfer device 36 as described above has the residual potential removed by the light emitted from the charge remover 37 and then has the residual toner T removed by the cleaning belt 24, thus completing one printing process. The toner T attached to the cleaning belt 24 is attracted to the magnet roll 25 so as to adhere thereto and then scraped off by the blade 26 which is in pressure contact with the magnet roll 25, to drop into the toner moving passsage 32, in which the toner T is mixed into new toner T supplied from the toner cartridge 31 by the action of the stirrer 35 so as to be reused.

As described above, this embodiment enables one printing process to be completed within one turn of the photosensitive drum 21, so that it is possible to obtain excellent printing efficiency. In addition, this embodiment is economical since it is also possible to reuse the toner T remaining on the photosensitive drum 21. Further, it is possible to shorten the recording paper transport passage 41 and lower the frequency of generation of jamming of recording paper, which means that it is possible to improve reliablily.

Since the fixing device 48 is disposed in the uppermost portion of the housing 20 and the heat generated in the fixing device 48 is released to the outside from the upper wall 45 of the housing 20 and from the air duct 46, the heat exhaust efficiency is excellent, and there is no fear of the heat exerting any adverse effect on other members such as the photosensitive drum 21 even when no heat shielding structure is provided. Furthermore, it is possible to readily exchange recording paper discharging modes for each other simply by changing the position of the guide member 52.

As has been described above, it is possible, according to the present invention, to collect the toner remaining on the photosensitive member and reuse it, so that the economy is improved. Since it is possible to complete one printing process within one turn of the photosensitive member, the printing efficiency is also improved. Further, since the recording material is transported through a shortened transport passage, it is possible to lower the frequency of generation of jamming of the recoding material. The present invention also enables recording paper to be discharged onto the upper wall of the housing in a face-down state and further permits the heat generated in the fixing device to be effectively released to the outside of the housing.

Although the present invention has been described through specific terms, it should be noted here that the described embodiment is not necessarily limitative and various changes and modifications may be imparted thereto without departing from the scope of the invention which is limited solely by the appended claims.

What is claimed is:

1. An electrophotographic printer comprising:

a housing having opposing first and second sides in a longitudinal direction thereof;

a photosensitive member, disposed centrally of said housing between said first and second side, having a photosensitive surface which is moved cyclically in a development cycle;

a cleaner for removing any developer remaining on the surface of said photosensitive member after a development cycle;

a charger for applying electrostatic charges on the surface of said photosensitive member;

an optical writing member for forming an electrostatic latent image on the charged surface of said photosensitive member;

a developing member for making the latent image on the surface of said photosensitive member visible by applying a developer thereto;

a transfer device for transferring the visible image developed on the surface of said photosensitive member to a recording sheet;

sheet moving means for moving a recording sheet along the surface of said photosensitive member so that the visible image is transferred thereto by said transfer device;

a charge remover for removing any charge remaining on the surface of said photosensitive member, wherein at least said cleaner, said charger, said optical writing member, and said developing member are arranged serially in the order mentioned all on said first side of said housing along the surface of said photosensitive member, said cleaner and said developing member being at opposite ends of said serial arrangement, and wherein a developer moving passage is formed extending from said cleaner to said developing member for moving the developer removed by said cleaner to said developing member, said charger and said optical writing member being arranged alongside said developer moving passage facing the surface of said photosensitive member; and an internal casing mounting said charge remover, said cleaner, said charger, said optical writing member, and said developing member serially in the order mentioned all on said first side of said housing, said casing including a developer supply member proximate said cleaner, a curved back wall extending from said developer supply member and said cleaner to said developing member and forming said developer moving passage, and a frame holding said charger and said optical writing member separated from said developer moving passage.

2. An electrophotographic printer comprising:

a housing having opposing first and second sides in a longitudinal direction thereof;

a photosensitive member, disposed centrally of said housing between said first and second sides, having a photosensitive surface which is moved cyclically in a development cycle;

a cleaner for removing any developer remaining on the surface of said photosensitive member after a development cycle;

a charger for applying electrostatic charges on the surface of said photosensitive member;

an optical writing member for forming an electrostatic latent image on the charged surface of said photosensitive member;

a developing member for making the latent image on the surface of said photosensitive member visible by applying a developer thereto;

a transfer device for transferring the visible image developed on the surface of said photosensitive member to a recording sheet;

sheet moving means for moving a recording sheet along the surface of said photosensitive member so that the visible image is transferred thereto by said transfer device;

a charge remover for removing any charge remaining on the surface of said photosensitive member, wherein at least said cleaner, said charger, said optical writing member, and said developing member are arranged serially in the order mentioned all on said first side of said housing along the surface of said photosensitive member, said cleaner and said developing member being at opposite ends of said serial arrangement, and wherein a developer moving passage is formed extending from said cleaner to said developing member for moving the developer removed by said cleaner to said developing member, said charger and said optical writing member being arranged alongside said developer moving passage facing the surface of said photosensitive member; and a sheet supply device containing recording sheets which are fed by said sheet moving means to the surface of said photosensitive member, a transport member for transporting a recording sheet having the visible image transferred thereto by said transfer device from said photosensitive member, a fixing member for fixing the visible image on the recording sheet transported by said transport member, and a discharge port for discharging the recording sheet with the visible image fixed thereon from said housing, wherein said sheet supply device, said sheet moving means, and said transport member are arranged serially in the order mentioned all on said second side of said housing, said sheet supply device is disposed at a lower part of said second side of said housing, and said fixing member and said discharge port are arranged together in the vicinity of an upper wall at an upper part of said housing above said photosensitive member.

* * * * *